United States Patent [19]

Armstrong et al.

[11] Patent Number: 4,843,775

[45] Date of Patent: Jul. 4, 1989

[54] SQUARE BUTT DOOR FRAME AND METHOD OF ASSEMBLY

[75] Inventors: Laurence P. Armstrong, Weyerhaeuser; Scott A. Libby, Eau Claire, both of; James L. Peterson, Aurora, Ill.; Roger J. Norberg, Prairie Farm, Wis.

[73] Assignee: Nichols- Homeshield, Inc., Ill.

[21] Appl. No.: 252,111

[22] Filed: Oct. 3, 1988

[51] Int. Cl.[4] ..... E04C 2/38

[52] U.S. Cl. ..... 52/656; 403/231; 29/513

[58] Field of Search ..... 52/656, 211, 475; 403/231, 217, 274, 403, 247, 254, 252; 29/437, 513

[56] References Cited

U.S. PATENT DOCUMENTS

| | | | |
|---|---|---|---|
| 2,601,164 | 6/1952 | Montgomery | 403/231 |
| 2,617,502 | 11/1952 | Kessler | 403/231 |
| 3,363,371 | 1/1968 | Villalobos | 52/656 |
| 3,374,597 | 3/1968 | Whitener | 52/656 |
| 3,491,501 | 1/1970 | Lundgren | 52/656 |
| 4,034,866 | 7/1977 | Beckwith | 403/231 |

*Primary Examiner*—John E. Murtagh

*Attorney, Agent, or Firm*—Mann, McWilliams, Zummer and Sweeney

[57] ABSTRACT

A square butt hollow door frame including upper and lower rail members, and a pair of stile members wherein the inner walls of the stile members are provided at each end with a recess defining inwardly laterally extending flanges adapted to be received in corresponding slots defined through each end of the upper and lower rail members, such that when the respective flanges are received in the respective slots, a locking mechanism is positioned, thereby securing the side members and rail members together to form a door frame.

9 Claims, 2 Drawing Sheets

SQUARE BUTT DOOR FRAME AND METHOD OF ASSEMBLY

BACKGROUND OF THE INVENTION

The present invention relates to a door frame and a method of its assembly. More particularly, it relates to square butt hollow door frames. Numerous arrangements of this general type are shown in the prior art U.S. Pat. Nos. 3,004,641, 3,343,318, 3,827,485, 4,077,160, 4,327,535, 4,387,545, 4,546,585 and 4,606,170. None of the prior art discloses the features of the present invention.

SUMMARY OF THE INVENTION

The present invention provides a square butt door frame consisting of an upper rail member, a lower rail member and a pair of side or stile members. In one embodiment, each end of the front walls of the stile members defines a locking mechanism including an outwardly extending tab and each end of the rear walls defines a corresponding, outwardly extending tab. The inner walls of the stile members are recessed at each end to provide corresponding, inwardly extending opposing flanges. The upper and lower rail members define at each end a pair of opposing, corresponding slots adapted to receive the respective flanges of the stile members. The method of assembling the door frame includes inserting the flanges into the slots and folding the tabs over the edges of the side walls of the rail members to secure the stile members to the rail members.

DETAILED DESCRIPTION OF THE INVENTION

Figure 2:
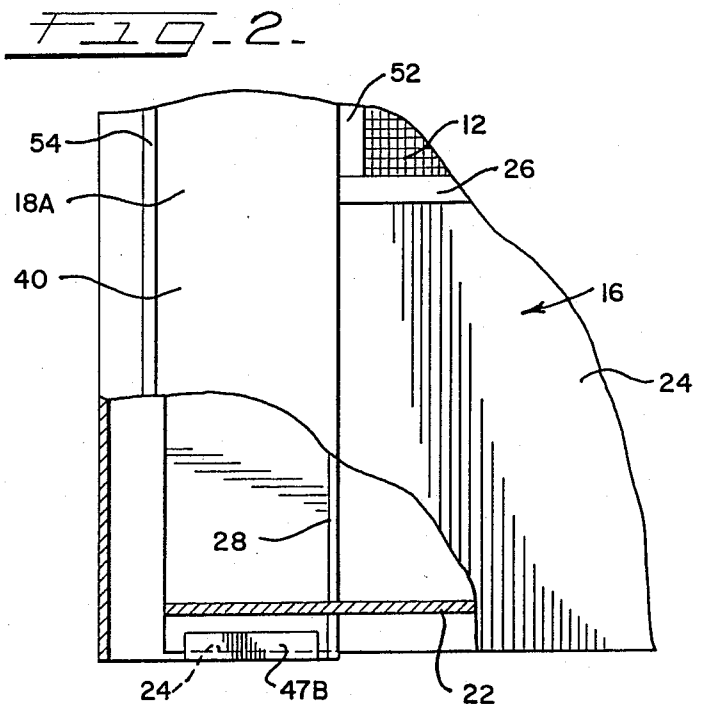
FIG. 2 shows the partially broken-away lower left corner of the door frame in FIG. 1.

A square butt door frame, generally indicated by the numeral 10, is shown in FIGS. 1–4. The frame 10 may support a screen 12 or other material as mesh, glazing, glass or other solid membrane. The frame 10 is of hollow construction and includes an upper rail member 14, a lower rail member 16 and a pair of side or stile members 18A and 18B. The upper and lower rail members 14, 16 are similarly constructed, one being the inverted mirror-image of the other, with the exception that the height of the lower rail member 16 is shown greater than the height of the upper rail member 14, however, it may also be the same height or lesser. In all other respects, the rail members 14 and 16 are the same. Bearing this in mind, the detailed description of the lower rail member 16 illustrated in FIG. 4 will be equally applicable to the upper rail member 14. Likewise, the stile members 18A and 18B are also substantially identical, each being the inverted mirror-image of the other.

Figure 4:
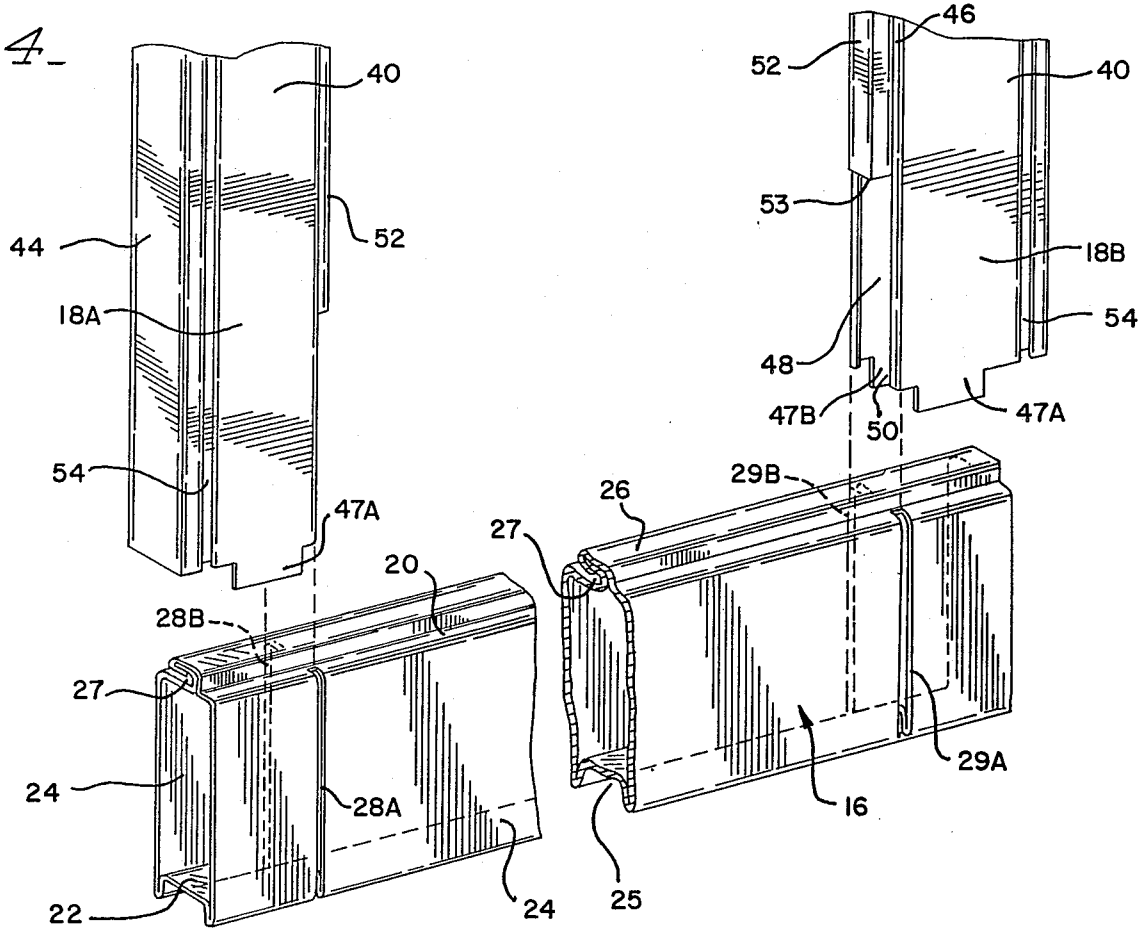
FIG. 4 is an exploded, partially broken away, view showing the assembly of the stile members onto the lower rail member of the door frame.

As best seen in FIG. 4, the lower rail member 16 consists of a top surface 20, a bottom surface 22 and a pair of side walls 24. The side walls 24 extend downwardly beyond the bottom surface 22 to define a generally inverted U-shaped recess 25. The bottom surface 22 may be provided with a slot (not shown), to receive a roller means so that the door frame 10 can be made slidable. The top surface 20 is provided with an upwardly extending bent-over flange 26 which defines a channel 27 adapted to receive the lower edges of the screen 12. While a bent-over flange 26 is illustrated, it is understood that instead a generally U-shaped channel or any other mounting channel may be provided on the top surface 20 for receiving the lower edge of a glass panel or other solid membrane. The ends of the lower rail member 16 are open.

A pair of corresponding, opposing slots 28A and 28B and 29A and 29B is defined through the lower member 16 toward each end thereof. Each pair of slots 28 and 29 is defined through a portion of the top surface 20, through the side walls 24 and through a portion of the bottom surface 22. The slots 28A and 28B at one end of the lower member 16 are spaced the same distance from that open end as the slots 29A and 29B are spaced from that open end. These slots are aligned with corresponding slots formed in the upper rail member 14.

As stated above, the side or stile members 18A and 18B are substantially identical. The stile members 18 have a slightly larger width than the upper and lower rail members 14 and 16. Each stil member 18 defines a front wall 40, a rear wall 42, an outer side wall 44 and an inner side wall 46. In the preferred embodiment, the front wall 40 defines at each end thereof an outwardly extending tab 47A. The rear wall 42 defines at each end a corresponding, outwardly extending tab 47B. Both ends of the stile members 18 are open.

As seen in FIG. 4, the lower end of stile 18B defines a recess 48 in the inner side wall 46. The recess 48 extends a distance approximately equal to the height of the lower rail member 16. The recess 48 defines at each side a pair of opposing, corresponding, inwardly extending flanges 50. The flanges 50 of the stile 18B are adapted to be slidably received in the slots 29A and 29B. The corresponding flanges 50 of stile 18A are adapted to be received in slots 28A and 28B. The inner side wall 46 of the stile member 18B is provided with a bent-over flange 52 which extends outwardly therefrom. The flange 52 is similar to the flange 26 on the lower rail member 16 and also defines a mounting channel 53 for receiving the side edges of the screen 12. As with the lower rail member flange 26, a generally U-shaped channel may be substituted for the bent-over flange 52 to accommodate the side edge of a glass panel or other solid membrane. The front wall 40 of each stile member 18 defines a groove 54 which extends the height thereof and is adapted to receive weather stripping, bug seal or some similar material.

Figure 1:
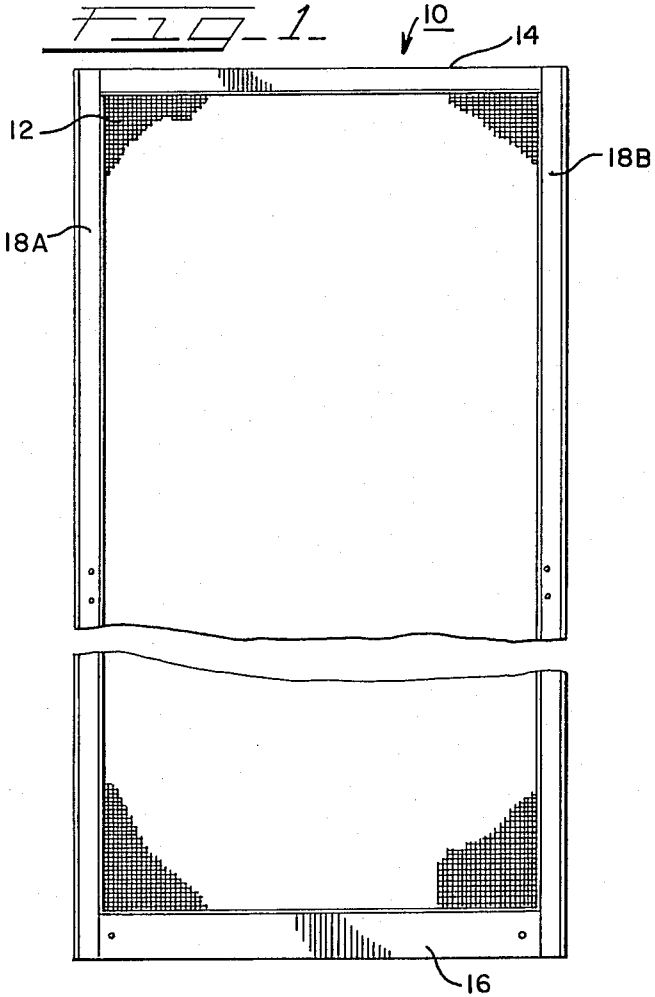
FIG. 1 shows the partially cut-away, assembled square butt door frame of the present invention.

In the illustrated embodiment, the upper end of each stile member 18, is configured substantially identical to the lower end, except that the length of the recess is sized to be slightly longer than the height of the upper rail member 14, or in other words, the upper recess is shorter than the lower recess 48. This is because the height of the upper rail member 14, illustrated in FIG. 1, is shorter than the height of the lower rail member 16. It is understood, however, that the length of the upper recess may be longer or equal to the length of the lower recess 48 depending on the height of the upper rail member 14 in relation to the height of the lower rail member 16.

Figure 3:
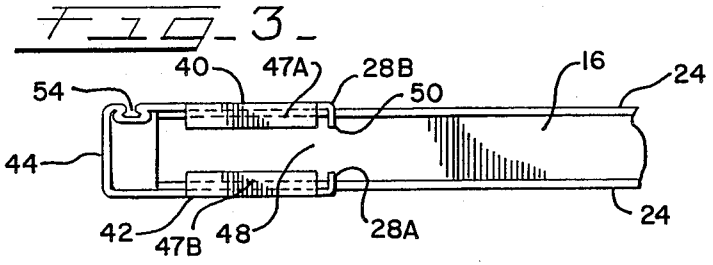
FIG. 3 is a bottom view of the lower left corner portion of the door frame in FIG. 2.

The frame 10 is assembled as follows. The recess flanges 50 of the stile members 18A and 18B are aligned with and inserted into the respective corresponding slots 28A and 28B and 29A and 29B defined at the ends of the lower rail member 16, such that the ends of the lower rail member 16 are disposed within the recesses 48 and covered by the outer side wall 44. The overlap of the stile member 18 and lower rail member 16 maximizes the bearing surface contact and lateral strength. The locking mechanism associated with the stile members 18 is then actuated so as to secure the upper and lower rail members 14 and 16 and the stile members 18 together. As seen in the embodiment of FIG. 3, the locking mechanism includes the lower tabs 47A and 47B, which are folded inwardly and over the lower edges of the respective side wall 24 of the lower rail member 16, such that the inner surfaces of tabs 47A and 47B lie adjacent the inner surfaces of the respective side wall 24, thereby locking the stile members 18 and lower rail member 16 in secure relation. The upper ends of the stile members 18A and 18B are then secured to the upper rail member 14 in the same manner with the upper tabs 47A and 47B being folded over the side walls of the upper rail member 14 to secure it to the stiles 18A and 18B.

Although the preferred form of the locking mechanism illustrated in FIGS. 2–4 consists of tabs 47 which are foldable over the side walls 24, other forms of locking mechanisms are also contemplated as being within the scope of the present invention. For example, the tabs 47 could be eliminated and the end portions of the flanges 50 which extend below the bottom surface 22 could be bent, staked or otherwise deformed so as to be substantially parallel with the inner surface of the side walls 24. The same could be done with the ends of the flanges 50 which extend above the top surface of the upper rail. Such a locking mechanism would also secure the rail and stile members together and form a door frame.

Thus it has been shown that the present invention provides a square butt door frame which may be easily, quickly and inexpensively assembled without the use of fasteners, glues or press-fit cornerlocks.

Various features of this invention have been particularly shown and described in connection with the illustrated embodiment of the invention. However, it must be understood that these particular arrangements merely illustrate and that the invention is to be given its fullest interpretation within the terms of the appended claims.

What is claimed is:

1. A square butt door frame including an upper rail member of hollow, tubular construction defining a top surface, a bottom surface and a pair of side walls, a first recess defined in said top surface of said upper rail member, a pair of corresponding, opposing slots defined in and located toward each end of said upper rail member, a lower rail member of hollow tubular construction defining a top surface, a bottom surface and a pair of side walls, a second recess defined in said bottom surface of said lower rail member, a pair of corresponding, opposing slots defined in and located toward each end of said lower rail member, said corresponding pairs of slots in said upper rail member being aligned with said slots in said lower rail member, a pair of stile members of hollow tubular construction, the opposing ends of each said stile member being open, each of said stile members defining a front wall, a rear wall, an outer side wall and an inner side wall, a recess defined in said inner side wall at each end of said stile member, said recess at one end sized to receive said upper rail member, said recess at said other and sized to receive said lower rail member, each said recess defining a pair of corresponding, opposing flanges extending inwardly from said respective inner side walls, the pair of flanges defined by said one recess adapted to be received in said upper rail member slots and the pair of flanges defined by said other recess adapted to be received in said lower rail member slots and locking means associated with each of said stile members, said locking means including at least one tab member extending from each end of said stile member, said tab members adapted to assume a first, unlocked position, extending above said top surface of said upper rail member and below said bottom surface of said lower rail member, said tab members being further adapted to assume a second, locked position, lying within said first and second recesses of said upper and lower rail members, respectively, said locking means operative such that when said upper and lower rail members are positioned within the recesses formed in said stile members and said tab members are positioned within said first and second recesses of said upper and lower rail members, said rail members and stile members are secured together to form a door frame.

2. The door frame of claim 1 including mounting means disposed on said upper and lower rail members and said stile members for securing a screen or window in the aperture defined within said door frame.

3. The door frame of claim 2 wherein said mounting means includes a bent-over flange on said top surface of said lower rail member, said flange extending upwardly therefrom and defining a channel, said channel adapted to receive the lower edge of a screen, and a corresponding bent-over flange on said bottom surface of said upper rail member extending downwardly therefrom and defining a channel, said upper rail channel adapted to receive the upper edge of said screen.

4. The door frame of claim 2 wherein said mounting means includes corresponding bent-over flanges on said inner side walls of said stile members, said corresponding flanges extending outwardly therefrom and defining respective channels adapted to receive the side edges of said screen.

5. The door frame of claim 1 wherein said locking means includes tab members, one extending outwardly from each of the ends of said front walls of said stile members, and corresponding tab members, one extending outwardly from each of the ends of said rear walls of said stile members.

6. The door frame of claim 1 wherein said locking means include said recess flanges of said stile members, said recess flanges extending respectively beyond said top surface of said upper rail member and said bottom surface of said lower rail member, said recess flanges being bendable into said first and second recesses of said upper and lower rail members to secure said rail and stile members together.

7. The method of assembling a square butt door frame, said frame having a hollow construction and including an upper rail member having a first recess defined in the top surface thereof, a lower rail member having a second recess defined in the bottom surface thereof and a pair of stile members, the inner walls of each said stile member provided at the upper and lower end with a recess defining a pair of corresponding, opposing, laterally inwardly-extending flanges, said rail members defining at each end a pair of corresponding, opposing slots, said stile members including locking means positionable so as to secure said rail members and stile members together, the method of assembly including the steps of inserting said lower recess flanges of each of said stile members into the respective pair of said slots in said lower rail member such that the ends of said lower rail member are disposed within said respective lower recesses in said stile members, inserting said upper recess flanges of each of said stile members into the respective pair of said slots in said upper rail member such that the ends of said upper rail member are disposed within said respective upper recesses in said stile members and moving said locking means on said stile members to a position within said first and second recesses of said upper and lower rail members so as to secure said rail members and said stile members together, thereby forming a door frame.

8. The method of claim 7, wherein said locking means consists of a tab member extending outwardly from each of the ends of the front and rear walls of said stile members, and extending respectively beyond the upper edges of the side walls of said upper rail member and the lower edges of the side walls of said lower rail member, said step of moving said locking means including the step of bending said tab members over said respective edges of said side walls of said rail members to secure said stile members to said rail members, whereby said tab members are positioned within said first and second recesses of said upper and lower rail members.

9. The method of claim 7, wherein said locking means includes said recess flanges of said stile members, said recess flanges extending respectively beyond the top surface of said upper rail members and the bottom surface of said lower rail member, said step of moving said locking means including the step of bending said recess flanges to secure said stile members to said rail members, whereby said locking means are positioned within said first and second recesses of said upper and lower rail members.

* * * * *